US005592186A

United States Patent [19]

Hoofe, IV et al.

[11] Patent Number: 5,592,186

[45] Date of Patent: Jan. 7, 1997

[54] SECTIONAL FILTER ASSEMBLY

[75] Inventors: William J. Hoofe, IV, Costa Mesa; John E. Schroeder, Huntington Beach, both of Calif.

[73] Assignee: Northrop Grumman Corporation, Los Angeles, Calif.

[21] Appl. No.: 397,338

[22] Filed: Mar. 2, 1995

[51] Int. Cl.[6] ..... H01Q 15/24

[52] U.S. Cl. ..... 343/909; 343/705

[58] Field of Search ..... 343/705, 756, 343/872, 909, 912, 915; 430/301, 304, 313, 318

[56] References Cited

U.S. PATENT DOCUMENTS

| | | | |
|---|---|---|---|
| 3,761,937 | 9/1973 | Tricoles et al. | 343/770 |
| 3,975,738 | 8/1976 | Pelton et al. | 343/872 |
| 4,125,841 | 11/1978 | Munk | 343/909 |
| 4,126,866 | 11/1978 | Pelton | 343/909 |
| 4,275,859 | 6/1981 | Bleday | 244/121 |
| 4,314,255 | 2/1982 | Kornbau | 343/909 |
| 4,352,108 | 9/1982 | Milne | 343/756 |
| 4,388,388 | 6/1983 | Kornbau et al. | 430/258 |
| 4,467,330 | 8/1984 | Vidal et al. | 343/872 |
| 4,570,166 | 2/1986 | Kuhn et al. | 343/872 |
| 4,574,288 | 3/1986 | Sillard et al. | 343/781 |
| 4,684,954 | 8/1987 | Sureau et al. | 343/909 |
| 4,772,890 | 9/1988 | Bowen et al. | 343/700 MS |
| 4,785,310 | 11/1988 | Rosen | 343/909 |
| 4,786,915 | 11/1988 | Cartwright et al. | 343/909 |
| 4,864,321 | 9/1989 | Sureau | 343/872 |
| 4,970,634 | 11/1990 | Howell et al. | 362/342 |
| 5,103,241 | 4/1992 | Wu | 343/909 |
| 5,140,338 | 8/1992 | Schmier et al. | 363/909 |
| 5,208,603 | 5/1993 | Yee | 363/909 |
| 5,373,305 | 12/1994 | Lepore, Jr. et al. | 363/872 |

*Primary Examiner*—Donald T. Hajec
*Assistant Examiner*—Tan Ho
*Attorney, Agent, or Firm*—Terry J. Anderson; Karl J. Hoch, Jr.

[57] ABSTRACT

A frequency selective device that consists of two or more frequency selective surfaces that are separately manufactured to exacting engineering tolerances. The two or more frequency selective surfaces are joined together by a seam in a manner such that the device appears electrically to be one surface without degrading radar system performance and aircraft low-observability characteristics.

10 Claims, 5 Drawing Sheets

SECTIONAL FILTER ASSEMBLY

FIELD OF THE INVENTION

The invention relates generally to the field of electronic warfare, and particularly to frequency selective surfaces of radomes that may be built onto aircraft.

BACKGROUND OF THE INVENTION

Man has engaged in war on the land, in the sea, in the air and in the electromagnetic spectrum. The electromagnetic spectrum has been used by the military for improved communications, guidance of aircraft and missiles and the navigation of ships and planes. A nation seeks control of the electromagnetic spectrum because of the military's increasing dependency on its use for surveillance of potential enemy forces, communications between military units, detection of enemy military forces and the guidance and control of aeroplanes and missiles. With a mastery of the electromagnetic spectrum, one adversary could achieve an indispensable technological advantage for conquering an enemy or discouraging a potential aggressor.

Electronic warfare is the employment of electronic devices and techniques for the purposes of determining the existence and disposition of an enemy's electronic aids to warfare and destroying or degrading the effectiveness of the enemy's electronic aids to warfare. Radar is a type of electronic warfare that utilizes beamed and reflected radio frequency (RF) energy for detecting and locating objects, measuring distances, altitude, navigating, homing, bombing, and other purposes. Radar equipment may be installed on aircraft. When radar is installed on an aircraft, a radar dome or "radome" is often used to streamline and protect the radar antenna or antennas from adverse environments. Electrically the radome must cause a minimum distortion of the electrical characteristics of the antenna radiation pattern.

High-performance radome designs may include frequency selective surfaces in their construction. The frequency selective surfaces are often constructed from conventional printed circuit RF filter elements. The frequency selective surfaces of the radomes are designed to take into account the desired bandwidth, frequency selectivity, and frequency roll-off characteristics of the radar. The mechanical parameters of the frequency selective surfaces of the radome (including overall geometry such as element size and shape) and the electrical properties (such as dielectric constants and conductivity of the various layers) are all interrelated properties which affect the performance of the frequency selective radome. In other words, the desired performance of the high performance radome is largely a function of element size and shape as well as element spacing, or distribution. For conventional frequency selective surfaces of radomes, the frequency and polarization response is dependent on the size and shape of the elements (which defines the response of the element itself) and the distribution of the elements (which defines the electromagnetic interaction between the elements). Thus, frequency selective surfaces of radomes have been designed to meet specific radome performance requirements.

Prior art radome design was mostly by cut and try methods. These methods were expensive and time consuming, since they relied on flight test data and radome failures to obtain a design.

As the prior art developed the element dimensional tolerances of frequency selective surfaces of radomes became more exacting. Computer simulations of the frequency selective surfaces of the radomes were performed to avoid costly design errors. When the simulations were performed it was assumed that all of the elements comprising a frequency selective surface were of uniform size, shape, and distribution. If the actual elements (e.g., slots) were not the same size that was simulated, the performance of the actual frequency selective surface would not be the same as modeled. Oftentimes, the actual frequency selective surface had different correlated errors in different regions of the slot array that caused distortion of the antenna pattern. These correlated errors in slot size caused phase errors which resulted in the pattern distortion and an increase in the side-lobe levels. In practice, unfortunately, the close manufacturing tolerances for the element size, shape and spacing make it exceedingly difficult to consistently construct the frequency selective surfaces of the radomes in a manner that will meet engineering design requirements as modeled.

One method utilized by the prior art for the construction of close tolerance frequency selective surface radomes was called the strip filter technique. The strip filter technique involved the producing of the frequency selective surfaces in three strips, using state-of-the-art printed circuit board technology to meet the element dimensional tolerance requirements. One of the difficulties encountered by the prior art was that it was hard to align the three strips and to join them in such a manner that the assembly would appear electrically to be one piece and not degrade aircraft low-observability characteristics. Thus, each radome would not necessarily have the same RF and RCS performance characteristics. The prior art attempted to solve the foregoing problem by filling the gaps between the three strips (during layup of the radome) with electrically conductive materials. Joining the strips by "filling the gaps" was problematic, however, for quality assurance reasons. Moreover, this joining technique did not achieve consistently satisfactory results.

Reference may be had to the following patents for further information concerning the state of the prior art.

In U.S. Pat. No. 3,761,937, issued Sept. 25, 1973 entitled "Radio Frequency Transmitting Apparatus Having Slotted Metallic Radio Frequency Windows" to Tricoles et al. there is disclosed a radome that has increased bandwidth capability. The radome may be made of a metallic sheet that has increased bandwidth capability. The radome may be made of a plurality of slots with edges that are beveled-towards each other from the outer surface of the sheet, such that the metallic walls of the window are thin and approach the skin depth for the highest frequency of the radio frequency waves which are transmitted.

In U.S. Pat. No. 3,975,738, issued Aug. 17, 1976 entitled "Periodic Antenna Surface of Tripole Slot Elements" to Pelton et al. there is disclosed an antenna system in which a conical shaped metallic radome has a surface-composed of a periodic array of radiating slot elements.

In U.S. Pat. No. 4,125,841, issued Nov. 14, 1978 entitled "Space Filter" to Munk there is disclosed a space-filter formed as a composite multi-layered structure that utilizes a periodic slot array structure nested between first and last strata of dielectric material. The filter exhibits a constant bandwidth characteristic over a broad range of angles of incident radiation.

In U.S. Pat. No. 4,126,866, issued Nov. 21, 1978 entitled "Space Filter Surface" to Pelton there is disclosed a surface that is used as a space filter in electromagnetic space. The filter surface is formed as a periodic array of recurrent filter components clustered in groups of three each incorporating pairs of elements extending outwardly at an internal angle of 120 degrees.

In U.S. Pat. No. 4,314,255, issued Feb. 2, 1982 entitled "Electromagnetic Angle Filter Including Two Staggered, Identical, Periodically Perforated Conductive Plates" to Kornbau there is disclosed an angle filter for electromagnetic radiation having a predetermined wavelength λ. The angle filter includes a planar parallel pair of perforated conductive plates having arrays of periodic perforations.

In U.S. Pat. No. 4,275,859, issued Jun. 30, 1981, entitled "Optical Dome Protection Device" to Bleday there is disclosed a rain and shock protection for an optical dome.

In U.S. Pat. No. 4,352,108, issued Sep. 28, 1992 entitled "Antenna Beam Shaping Structure Employing Dipoles Arrayed On A Parabolic Surface" to Milne there is disclosed an antenna beam shaping structure which comprises a first surface which is a surface of revolution swept out by a part of a parabolic curve rotated about and being included at an angle in the range of about 70 to 80 degrees to the antenna axis with the focus of the parabolic curve substantially on the antenna axis, and a set of electrically isolated dipoles mounted on the surface and similarly oriented such that they lie along one of (i) edges of axial planes of the antenna, or (ii) edges of planes normal to the antenna axis.

In U.S. Pat. 4,388,388, issued Jun. 14, 1983 entitled "Method of Forming Metallic Patterns On Curved Surfaces" to Kornbau et al. there is disclosed a method for forming frequency selective surfaces on a curved radome shell. The slots are etched into the metallic surface on the curved radome structure.

In U.S. Pat. No. 4,467,330, issued Aug. 21, 1984 entitled "Dielectric Structures For Radomes" to Vidal et al. there is disclosed a radome which has a dielectric material which has placed within it a plurality of ring-shaped elements, each forming a completely closed loop configuration, such elements producing an inductive effect substantially equal to the capacitive effect of the dielectric material so as to match the electrical characteristics of the structure to a selected range of frequencies of electromagnetic energy which is to be transmitted therethrough.

In U.S. Pat. 4,570,166 issued Feb. 11, 1986 entitled "RF-Transparent Shield Structures" to Kuhn et al. there is disclosed a dielectric plug that is used as an aid to protection against severe environmental conditions, especially as encountered in missile applications.

In U.S. Pat. No. 4,574,288, issued Mar. 4, 1986 entitled "Passive Electromagnetic Wave Duplexer For Millimetric Antenna" to Sillard et al. there is disclosed a passive duplexer for electromagnetic waves operated within the millimetric wave range.

In U.S. Pat. No. 4,684,954, issued Aug 4, 1987 entitled "Electromagnetic Energy Shield" to Sureau et al. there is disclosed a radome shutter structure which is placed in a closed or shut position when the diodes are biased in a forward or conductive state and is placed in an open condition when the diodes,are reversed biased or in a non-conductive state.

In U.S. Pat. No. 4,785,310, issued Nov. 15, 1988 entitled "Frequency Selective Screen Having Sharp Transition" to Rosen there is disclosed a frequency selective screen (18) that is employed as a diplexer to separate each of one or more-radio frequency signals into first and second bands of frequencies by allowing the first band of frequencies to pass therethrough and reflecting the second band of frequencies.

In U.S. Pat. No. 4,786,915, issued Nov. 22, 1988 entitled "Attenuation of Microwave Signals" to Cartwright et al. there is disclosed a membrane of absorbent plastic that is stretched across the aperture of a dish reflector.

In. U.S. Pat. No. 4,864,321, issued Sep. 5, 1989 entitled "Electromagnetic Energy Shield" to Sureau there is disclosed a structure for transmitting electromagnetic energy within a selected frequency range and preventing such transmission outside such range in which an insulative member has a metallized surface which includes an array of non-metallized regions each having the shape of a Jerusalem cross, the vertical and horizontal cross arms thereof having metallized regions along their length to form non-metallized gaps with the edges thereof.

In U.S. Pat. No. 4,970,634, issued Nov. 13, 1990 entitled "Radar Transparent Materials" to Howell et al. there is disclosed a structure for reflecting visible light, herein the structure is formed of a low dielectric constant material having an external surface comprising an electrically conductive layer of material which has an array of slots therein so as to be as substantially transparent to microwave radiation of a predetermined wavelength which will impinge upon the structure during use, while being reflective to light.

In U.S. Pat. No. 5,103,241 issued Apr. 7, 1992 entitled "High Q Bandpass Structure For The Selective Transmission and Reflection of High Frequency Radio Signals" to Wu there is disclosed a multi-layered structure that incorporates two separate frequency selective surfaces in a parallel spaced relationship. The frequency selective surfaces are embedded in rigid dielectric layers.

In U.S. Pat. No. 5,140,338 issued Apr. 7, 1992 entitled "Frequency Selective Radome" to Schmier et al. there is disclosed a two pole frequency selective surface for passing electromagnetic wave energy in a selected frequency band.

SUMMARY OF THE INVENTION

The "sectional filter assembly" of the present invention overcomes the disadvantages of the prior art by providing a frequency selective device that consists of two or more frequency selective surfaces that can be separately manufactured to exacting engineering tolerances. The sectional filter assembly is comprised of multiple details that are individually fabricated using state-of-the-art printed circuit board technology in order to meet the dimensional tolerance requirements for aperture size, shape and spacing. When properly joined, the frequency selective details appear electrically to be one piece. The joined assembly does not degrade radar system performance and does not degrade aircraft low-observability characteristics. The sectional filter assembly may be designed as a band-pass (radome) or a band-stop (reflector) surface.

An advantage of this invention is that a frequency selective surface (FSS) may be fabricated from any number of smaller-area FSS details, wherein the aperture size, shape and spacing of each detail can be accurately controlled. Hence, smaller-area FSS sections may be joined to form a larger-area FSS assembly in conformance with strict tolerances for aperture size, shape and spacing in order to meet engineering design criteria.

An additional advantage of this invention is the possible applications for its use in the area of FSS repair, wherein a damaged portion of a frequency selective surface may be removed and replaced.

DESCRIPTION OF THE PREFERRED EMBODIMENT

Figure 1:
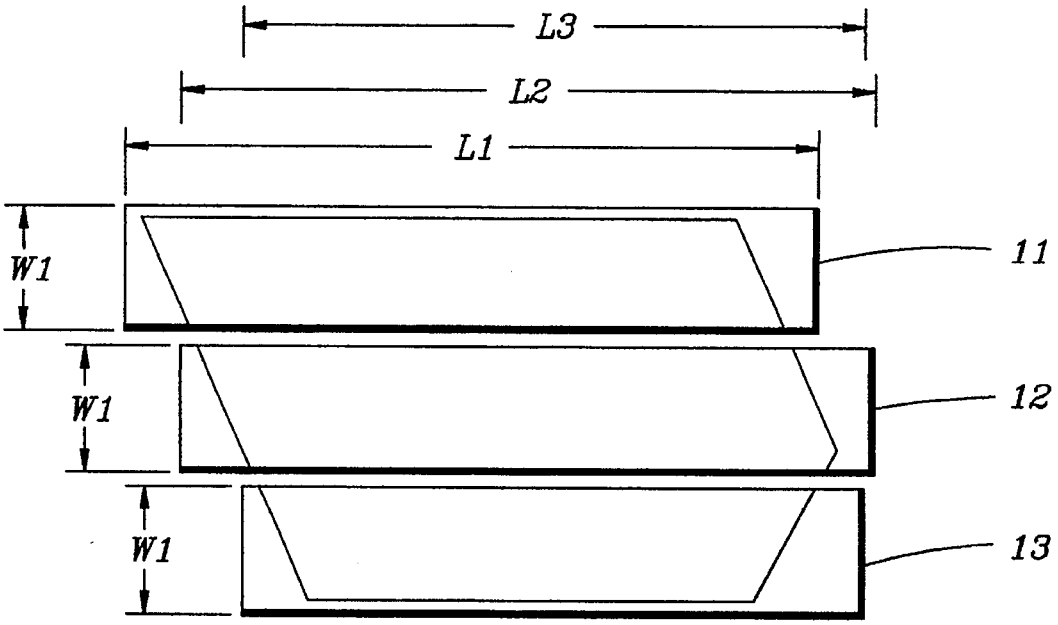
FIG. 1 is a drawing of unjoined frequency selective surface (FSS) sections.

Referring now to the drawings in detail, and more particularly to FIG. 1, the reference character 11 represents an unjoined frequency selective surface (FSS) section that has a length L1 and a width W1. In close proximity to section 11 is an unjoined FSS section 12, that has a length L2 and width W1 and in close proximity to section 12 there is an unjoined FSS section 13, that has a length L3 and width W1. Sections 11, 12 and 13 may be fabricated from raw materials of various lengths and widths. (However, sections 11, 12 and 13 are usually cut from raw material having the same width). Sections 11, 12 and 13 may be fabricated by any material thickness that is deemed appropriate. Thus, the FSS element size, shape and distribution may be varied according to the specific application of the assembled FSS sections 11, 12 and 13.

Figure 2:
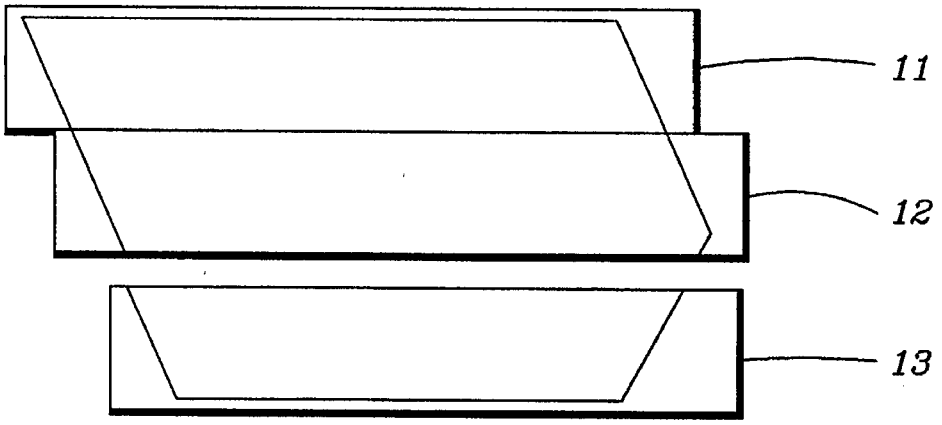
FIG. 2 is a drawing of two joined FSS sections and one unjoined FSS section.

FIG. 2 is a drawing showing joined FSS sections 11 and 12 and unjoined FSS section 13 in close proximity to section 12.

Figure 3A:
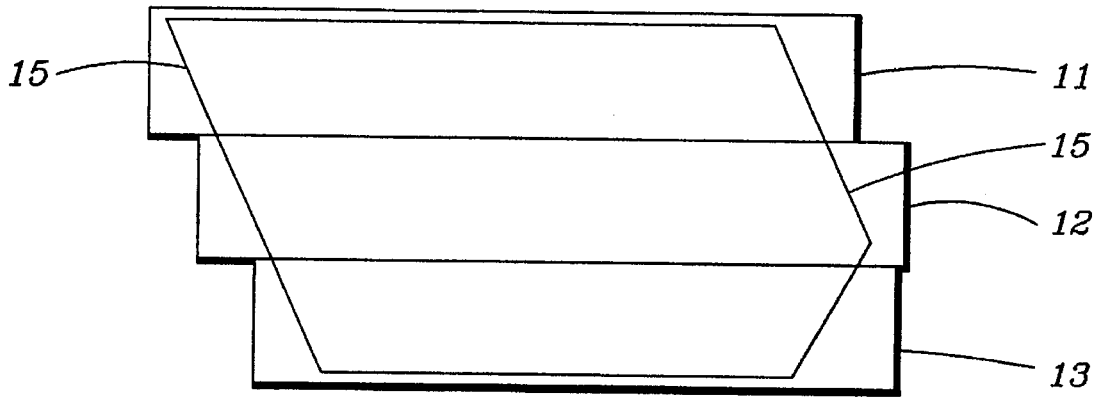
FIG. 3A is a drawing of an untrimmed sectional filter assembly.

FIG. 3A is a drawing showing sections 11, 12 and 13 joined and untrimmed. The manner in which sections 11, 12 and 13 are joined will be hereinafter described in the description of FIGS. 4A, 4B and 5. Excess material outside net trim line 15 provides a safety margin for the handling of sections 11, 12 and 13 when they are joined together by a seam.

Figure 3B:
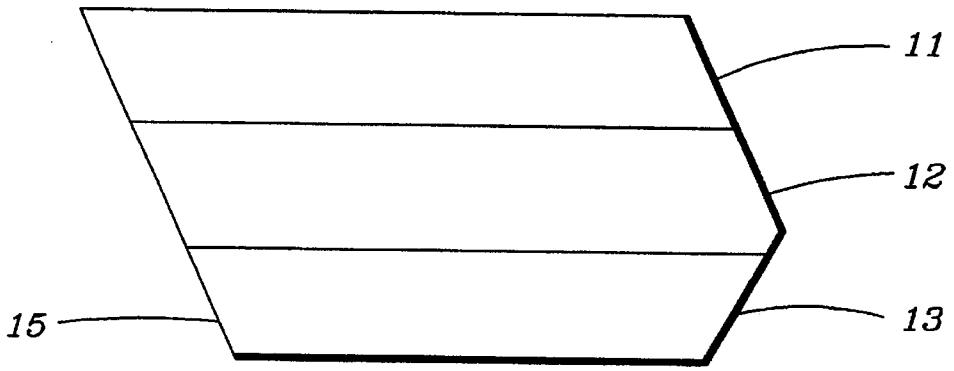
FIG. 3B is a drawing of a sectional filter assembly that has been cut to net trim.

FIG. 3B is a drawing showing sections 11, 12 and 13 joined and trimmed to trim line 15.

Figure 4A:
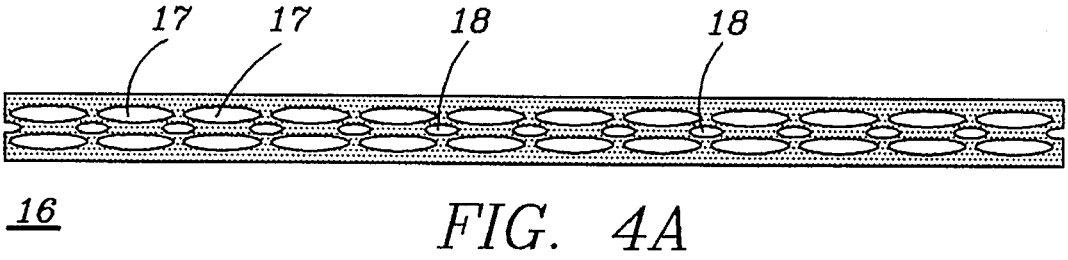
FIG. 4A is a drawing of a seam splice detail.

FIG. 4A is a drawing of a seam 16. Seam 16 is used to join sections 11, 12 and 13. Seam 16 is usually fabricated from 1 oz. copper foil that has a thickness of approximately 0.0014 inches. However, seam 16 may be fabricated from other materials that are known to one skilled in the art i.e, seam 16 is one seam having a length L1 of a plurality of seams that join sections 11, 12, and 13. Seam 16 may be manufactured as follows:

1) cut a plurality of seams 16 having a combined length L1;
2) clean seam 16 for application of photo-sensitive dry film;
3) apply photo-sensitive dry film to copper seam 16 by using standard photoprocessing techniques;
4) normalize seam 16 to room temperature; and
5) position seam 16 artwork on top of seam 16 and place in UV exposure vacuum machine so that seam 16 will have apertures 17 and ellipses 18 photographed on seam 16;
6) expose seam image on top side of copper seam 16 using standard photographic exposure equipment;
7) re-insert seam 16 in UV exposure vacuum machine and expose opposite side of seam 16 completely to harden a dry film on the back side of seam 16.
8) develop image of seam 16 using standard photographic developing techniques;
9) micro etch the exposed image of seam 16 in an appropriate etch machine to insure that seam 16 is the correct size; and
10) chemically remove the photosensitive dry film resist from the etched surface of seam 16 so that a plurality of apertures 17 and ellipses 18 are on the surface of seam 16.

Seam 16 has a plurality of apertures 17 that are pre-tinned with a high temperature solder material i.e, prior to joining sections 11 and 12, and sections 12 and 13 by seam 16. Apertures 17 are shown as elliptically shaped openings. Apertures 17 may also have other shapes i.e., circles.

Ellipses 18 are positioned between pairs of apertures 17 to align seam 16.

Figure 4B:
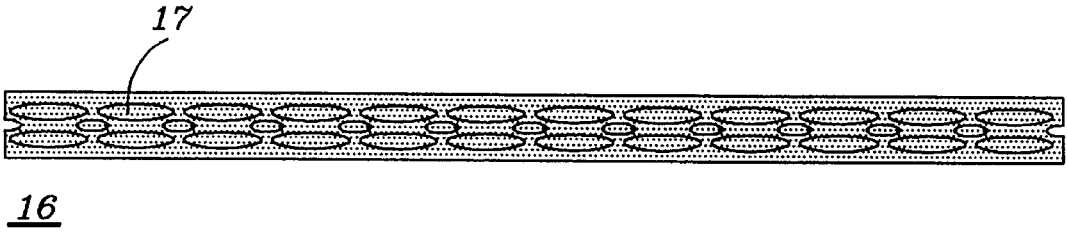
FIG. 4B is a drawing of a pre-tinned seam splice.

FIG. 4B is a drawing of a solder pre-tinned seam 16. Seam 16 was coated with solder to enable seam 16 to be joined with solder to sections 11 and 12 with less heat. It is desirable to use less heat to prevent loss of dimensioning and limit the amount of solder used to insure good mechanical bonding and preserve the electrical characteristics of sections 11 and 12, i.e., the radar cross section.

Seams 16 may be segmented i.e., joined end-to-end depending upon the length of the section they are joining or seams 16 may be continuous.

Figure 5:
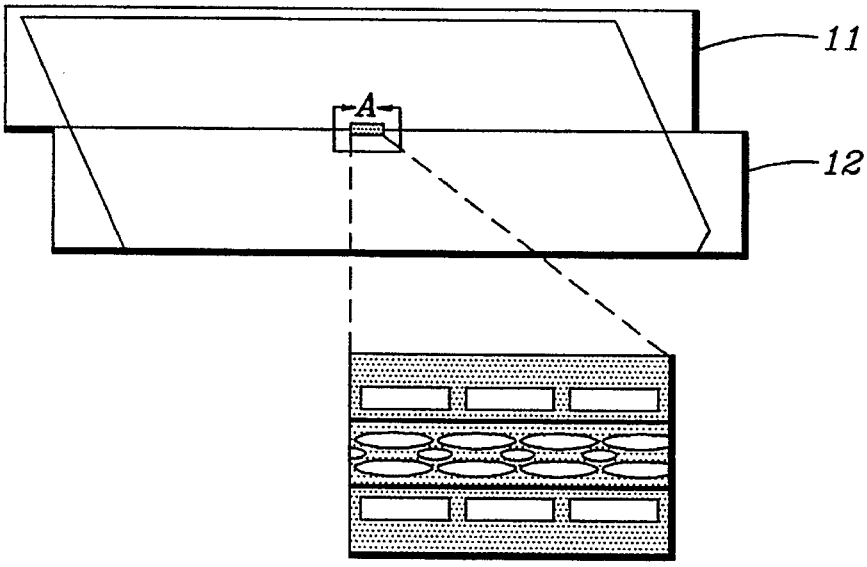
FIG. 5 is a drawing of two joined FSS sections showing seam registration.

FIG. 5 is a drawing of joined FSS sections 11 and 12 showing seam 16 registration. This is accomplished by the following process:

1) measure and mark solder demarcation line for application of seam 16 (detail A);
2) apply solder resist tape on sections 11 and 12 to prevent flow of solder onto sections 11 and 12 other than were seam 16 is;
3) micro etch bronze at the edges of sections 11 and 12 to promote bonding of sections 11 and 12 to the radome using seam 16;
4) align sections 11 and 12 to and solder pre-tinned seam 16 to sections 11 and 12 to preserve registration and alignment of the elements (slot to slot dimensions from sections 11 and 12 to preserve radar cross section); and
5) remove tape and clean seam 16 and sections 11 and 12.

It is obvious to one skilled in the art that additional filter sections may be attached in accordance with the above process.

Seam 16 enables joined sections 11 and 12 to appear electrically to be one piece without detriment to radar systems performance and aircraft low-observability characteristics.

Figure 6:
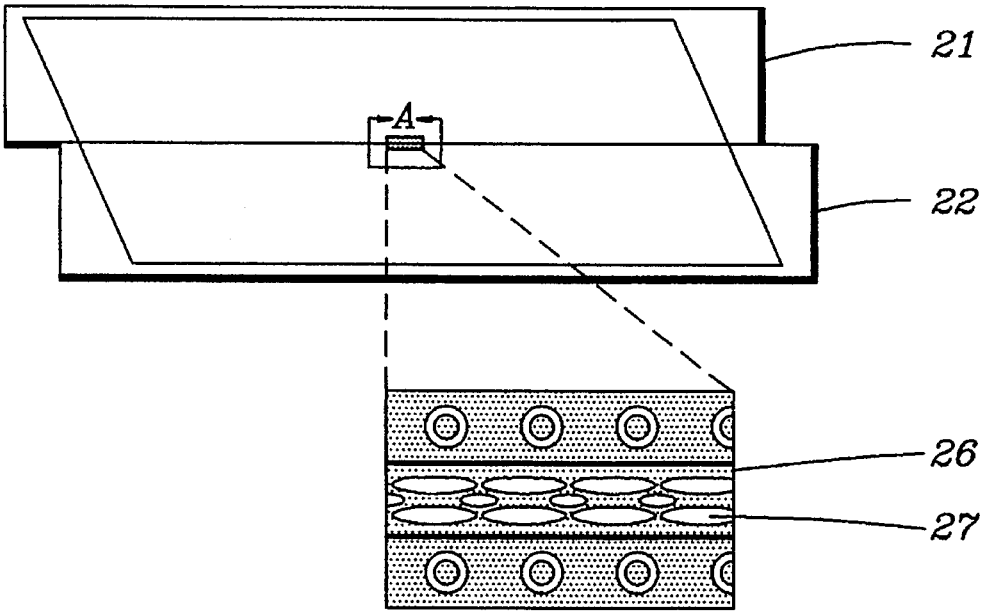
FIGS. 6, 7, 8A, 8B and 9 are drawings of alternate embodiments of this invention.

FIG. 6 is a drawing of an alternate embodiment of this invention showing the joined FSS sections 21 and 22 with seam 26 registration. This is accomplished by the following process:

1) measure and mark solder demarcation line for application of seam 26 (detail A);
2) apply solder resist tape on Sections 21 and 22 to prevent flow of solder onto sections 21 and 22 other than were seam 26 is;
3) micro etch bronze at the edges of sections 21 and 22 to promote bonding of sections 21 and 22 to the radome using seam 26;
4) align sections 21 and 22 to and solder pre-tinned seam 26 to sections 21 and 22 to preserve registration and alignment of the elements (slot to slot dimensions from sections 21 and 22 to preserve radar cross section); and
5) remove tape and clean seam 26 and sections 21 and 22.

It is obvious to one skilled in the art that additional filter sections may be attached in accordance with the above process.

Seam 26 enables joined sections 21 and 22 to appear electrically to be one piece without detriment to radar systems performance and aircraft low-observability characteristics. Seam 26 has a plurality of apertures 27.

Figure 7:
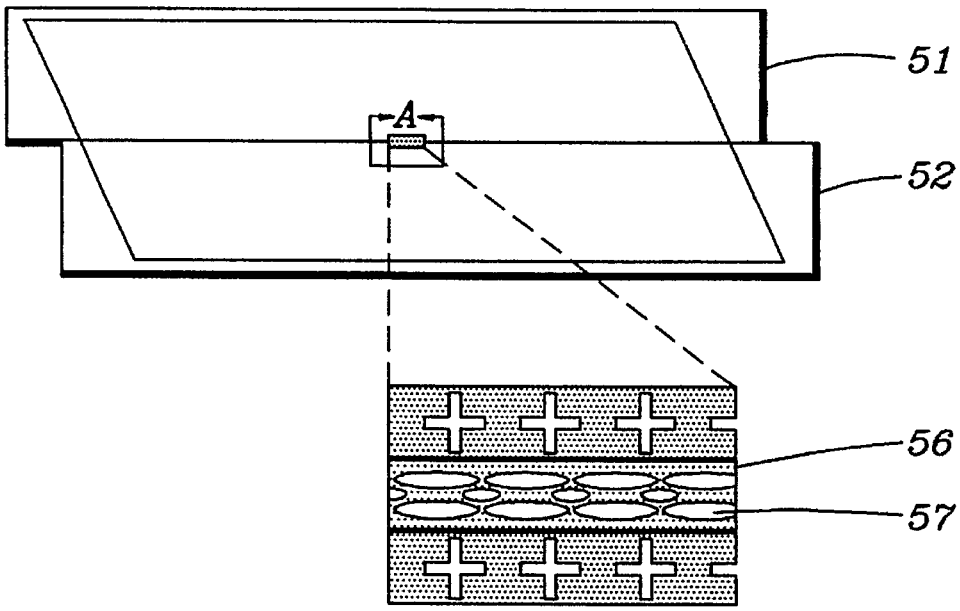

FIG. 7 is a drawing of joined FSS sections 51 and 52 showing seam 56 registration. This is accomplished by the following process:

1) measure and mark solder demarcation line for application of seam 56 (detail A);

2) apply solder resist tape on sections 51 and 52 to prevent flow of solder onto sections 51 and 52 other than were seam 56 is;
3) micro etch bronze at the edges of sections 51 and 52 to promote bonding of sections 51 and 52 to the radome using seam 56;
4) align sections 51 and 52 to and solder pre-tinned seam 16 to sections 51 and 52 to preserve registration and alignment of the elements (slot to slot dimensions from sections 51 and 52 to preserve radar cross section); and
5) remove tape and clean seam 56 and sections 51 and 52.

It is obvious to one skilled in the art that additional filter sections may be attached in accordance with the above process.

Seam 56 enables joined sections 51 and 52 to appear electrically to be one piece without detriment to radar systems performance and aircraft low-observability characteristics.

Figure 8A:
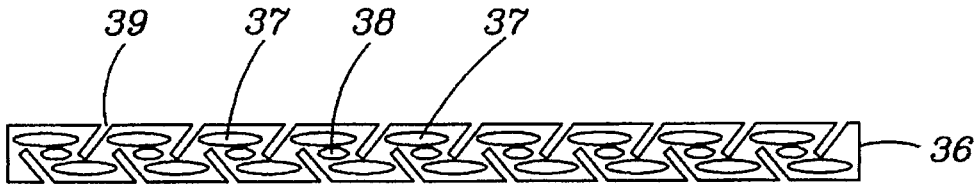

FIG. 8A is a drawing of a seam 36. Seam 36 is used to join sections 41 and 42. Seam 36 is usually fabricated from 1 oz. copper foil that has a thickness of approximately 0.0014 inches. However, seam 36 may be fabricated from other materials that are known to one skilled in the art i.e, seam 36 is one seam having a length L1 of a plurality of seams that join sections 21 and 22. Seam 36 may be manufactured as follows:

1) cut a plurality of seams 36 having a combined length L1;
2) clean seam 36 for application of photo-sensitive dry film;
3) apply photo-sensitive dry film to copper seam 36 by using standard photoprocessing techniques;
4) normalize seam 36 to room temperature; and
5) position seam 36 artwork on top of seam 36 and place in UV exposure vacuum machine so that seam 36 will have apertures 37, ellipses 38, and integrated FSS elements 39 photographed on seam 36;
6) expose seam image on top side of copper seam 36 using standard photographic exposure equipment;
7) re-insert seam 36 in UV exposure vacuum machine and expose opposite side of seam 36 completely to harden a dry film on the back side of seam 36.
8) develop image of seam 36 using standard photographic developing techniques;
9) micro etch the exposed image of seam 36 in an appropriate etch machine to insure that seam 36 is the correct size; and
10) chemically remove the photosensitive dry film resist from the etched surface of seam 36 so that a plurality of apertures 37, ellipses 38, and integrated FSS elements 39 are on the surface of seam 36.

Seam 36 has a plurality of apertures 37 and integrated FSS elements 39 that are pre-tinned with a high temperature solder material i.e, prior to joining sections 41 and 42, by seam 36. Apertures 37 are shown as elliptically shaped openings. Apertures 37 may also have other shapes i.e., circles.

Ellipses 38 and integrated FSS elements 39 are integrated to align seam 36.

Figure 8B:
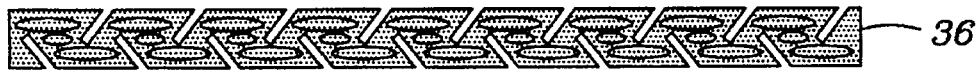

FIG. 8B is a drawing of a solder pre-tinned seam 36. Seam 36 was coated with solder to enable seam 36 to be joined with solder to sections 41 and 42 with less heat. It is desirable to use less heat to prevent loss of dimensioning and limit the amount of solder used to insure good mechanical bonding and preserve the electrical characteristics of sections 41 and 42, i.e., the radar cross section.

Seams 36 may be segmented i.e., joined end-to-end depending upon the length of the section they are joining or seams 36 may be continuous.

Figure 9:
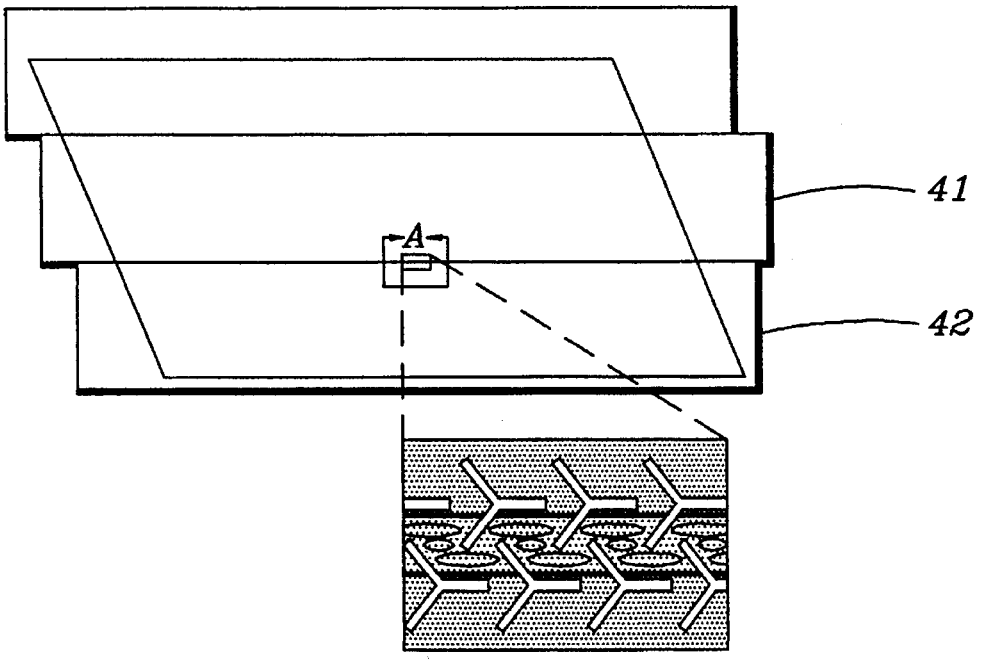

FIG. 9 is a drawing of a joined FSS section 41 and 42 showing seam 36 registration. Seam 36 was manufactured in the same manner as the seams heretofore mentioned. Seam 36 utilizes integrated FSS portions of elements from a nested FSS filter.

It is obvious to one skilled in the art that additional filter sections may be attached in accordance with the above process. It will also be obvious to one skilled in the art that the FSS elements shown above could be nested or not nested into the seam detail. It will also be obvious to one skilled in the art that the seam may be fabricated from other copper-like materials.

The above specification describes a new and improved way of joining frequency selective surfaces. It is realized that the above description may indicate to those skilled in the art additional ways in which the principals of this invention may be used without departing from the spirit. It is,therefore, intended that this invention be limited only by the scope of the appended claims.

We claim:

1. A frequency selective device that appears electrically to be one surface without degrading radar system performance and aircraft low-observability characteristics said device comprising:

two or more frequency selective surfaces that are individually fabricated to meet dimensional tolerances for FSS element size, shape, and spacing; and means for joining said surfaces together edge-to-edge, whereby said surfaces provide respective sections of said device;

wherein said joining means comprises a seam overlapping abutting edges of two of said frequency selective surfaces, said seam comprising a perforated electrically conductive foil.

2. The device claimed in claim 1, wherein said two or more surfaces are assembled as a band pass device.

3. The device claimed in claim 1, wherein said two or more surfaces are assembled as a band-stop device.

4. The device claimed in claim 1, wherein said means for joining comprises:

one or more seams that join said two or more surfaces together.

5. A frequency selective device that appears electrically to be one surface without degrading radar system performance and aircraft low-observability characteristics said device comprises:

two or more frequency selective surfaces that are individually fabricated to meet dimensional tolerances for FSS element size, shape and spacing; and a copper seam for joining said surfaces together edge-to-edge, whereby said surfaces provide respective sections of said device.

6. A frequency selective device that appears electrically to be one surface without degrading radar system performance and aircraft low-observability characteristics said device comprises:

two or more frequency selective surfaces that are individually fabricated to meet dimensional tolerances for FSS element size, shape and spacing; and a copper seam that is formed by photoprocessing techniques for joining said surfaces together edge-to-edge, whereby said surfaces provide respective sections of said device.

7. The device claimed in claim 6, wherein said seam has a plurality of apertures that are pre-tinned with a high temperature solder material.

8. The device claimed in claim 7, wherein said apertures are elliptically shaped openings.

9. The device claimed in claim 7, wherein said apertures are circular shaped openings.

10. The device claimed in claim 7, wherein said seam, in the case of a nested-element-type FSS, contains portions of said nested elements.

* * * * *

UNITED STATES PATENT AND TRADEMARK OFFICE

CERTIFICATE OF CORRECTION

PATENT NO. : 5,592,186
DATED : January 7, 1997
INVENTOR(S) : William James Hoofe IV, John Edward Schoeder It is certified that error appears in the above-identified patent and that said Letters Patent is hereby corrected as shown below:

Column 1,
Line 8, please add: STATEMENT OF GOVERNMENT RIGHTS
This invention was made with Government Support under contract F33657-81-C-0067 awarded by the United States Air Force. The Government has certain rights in this invention.

Signed and Sealed this

Sixth Day of November, 2001

*Attest:*

Nicholas P. Godici

*Attesting Officer*

NICHOLAS P. GODICI
*Acting Director of the United States Patent and Trademark Office*